US012628927B2

(12) United States Patent
French-Jackson

(10) Patent No.: US 12,628,927 B2
(45) **Date of Patent: *May 19, 2026**

(54) HAIR IRON

(71) Applicant: Chaska French-Jackson, Tulsa, OK (US)

(72) Inventor: Chaska French-Jackson, Tulsa, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/526,441

(22) Filed: Nov. 15, 2021

(65) Prior Publication Data

US 2022/0071365 A1 Mar. 10, 2022

Related U.S. Application Data

(63) Continuation of application No. 15/826,355, filed on Nov. 29, 2017, now Pat. No. 11,172,744.

(60) Provisional application No. 62/428,028, filed on Nov. 30, 2016.

(51) Int. Cl.

| | |
|---|---|
| ***A45D 20/10*** | (2006.01) |
| ***A45D 2/00*** | (2006.01) |
| ***A45D 20/12*** | (2006.01) |

(52) U.S. Cl.

CPC ..... *A45D 2/001* (2013.01); *A45D 20/10* (2013.01); *A45D 20/12* (2013.01)

(58) Field of Classification Search

CPC ..... A45D 20/10; A45D 20/48; A45D 20/50; A45D 1/02; A45D 1/04; A45D 1/06; A45D 1/08; A45D 2/001

See application file for complete search history.

(56) References Cited

U.S. PATENT DOCUMENTS

| | | | |
|---|---|---|---|
| 6,138,376 | A | 10/2000 | Garfinkel |
| D465,611 | S | 11/2002 | Tobin et al. |
| D491,310 | S | 6/2004 | Glucksman et al. |
| 6,895,975 | B2 | 5/2005 | Hafemann |
| 8,096,307 | B2 | 1/2012 | Hafemann |
| 8,124,914 | B2 | 2/2012 | Yu |
| 8,607,470 | B2 | 12/2013 | Richmond et al. |
| 9,012,813 | B2 | 4/2015 | Mourad |

(Continued)

FOREIGN PATENT DOCUMENTS

| | | | |
|---|---|---|---|
| DE | 9100180 U1 * | 5/1992 | ..... A45D 20/50 |
| DE | 102012210275 A1 * | 12/2013 | |

OTHER PUBLICATIONS

International Search Report and Written Opinion (PCT/US2018/062965); Mar. 22, 2019; 12 pgs.

*Primary Examiner* — Edelmira Bosques
*Assistant Examiner* — Sarah Woodhouse
(74) *Attorney, Agent, or Firm* — Dunlap Codding, P.C.

(57) ABSTRACT

A hair iron having a first handle member pivotally connected to a second handle member, a first styling head extending from the first handle member, and a second styling head extending from the second handle member. Each of the first and second styling heads comprises a housing having a plurality of air inlets, a styling element having a plurality of air outlets, a heat element disposed in the housing, and a motorized fan disposed in the housing between the air inlets and the heat element for pulling air through the air inlets and pushing air over the heat element and through the nozzles and through the air outlets. The styling heads are oriented so that the styling elements are in a face-to-face relationship.

12 Claims, 5 Drawing Sheets

(56) References Cited

U.S. PATENT DOCUMENTS

| | | | | |
|---|---|---|---|---|
| D754,396 | S | 4/2016 | Keong | |
| D759,306 | S | 6/2016 | Delassus | |
| D773,119 | S | 11/2016 | Yue et al. | |
| 2005/0087205 | A1* | 4/2005 | Rizzuto | A45D 1/04 132/228 |
| 2006/0108344 | A1* | 5/2006 | Kim | A45D 1/06 392/379 |
| 2008/0041409 | A1* | 2/2008 | Leung | A45D 7/02 132/224 |
| 2010/0089413 | A1* | 4/2010 | Wright | A45D 2/001 132/211 |
| 2011/0120491 | A1 | 5/2011 | You | |
| 2011/0139172 | A1* | 6/2011 | Silva | A45D 2/001 132/269 |
| 2011/0232672 | A1 | 9/2011 | Ammann | |
| 2013/0112221 | A1 | 5/2013 | Kock | |
| 2015/0114425 | A1 | 4/2015 | Park | |
| 2015/0196105 | A1 | 7/2015 | Leung | |
| 2015/0201727 | A1 | 7/2015 | De Benedictis et al. | |
| 2015/0216281 | A1 | 8/2015 | De Benedictis et al. | |
| 2015/0237982 | A1 | 8/2015 | Kock | |
| 2016/0166037 | A1 | 6/2016 | Teramoto et al. | |
| 2016/0242524 | A1* | 8/2016 | Floessholzer | A45D 20/122 |
| 2017/0127785 | A1* | 5/2017 | Chan | A45D 2/02 |
| 2017/0202332 | A1 | 7/2017 | Keong et al. | |
| 2017/0215541 | A1 | 8/2017 | Yeung | |

* cited by examiner

HAIR IRON

CROSS-REFERENCE TO RELATED APPLICATION

The present application is a continuation of U.S. Ser. No. 15/826,355, filed on Nov. 29, 2017, which claims benefit to U.S. Provisional Application Ser. No. 62/428,028, filed on Nov. 30, 2016; the entire contents of each being hereby expressly incorporated herein by reference.

BACKGROUND

Many consumers use some kind of hair apparatus to style their hair, such as a hair dryer or various kinds of irons. Hair dryers dry and style hair by speeding up evaporation of water from the hair's surface and separating strands of hair from one another. However, use of a hair dryer alone can result in static electricity, leaving the hair tangled or frizzy, and therefore does not smooth the hair to the satisfaction of many users. Ionic hair dryers have been developed to reduce static electricity and frizz, but many users still must use an additional styling tool, such as a flat iron, to achieve a desired style and smoothness. Unfortunately, flat irons do not work on wet hair. Therefore, many users spend thirty minutes to an hour drying their hair and then another thirty minutes to an hour smoothing their hair with a flat iron. Drying and styling freshly washed hair can therefore be a time consuming, multi-step process when done using conventional hand-held drying and ironing devices.

In addition to taking at least two time-consuming steps, this multi-step process often requires the user to purchase and use more than one device, namely a hair dryer and a flat iron. Currently known devices that include a dryer and styling device in one fail to uniformly distribute air flow across the surface area of a section of hair and do not have any means for effectively concentrating and directing airflow. Previous conventional hair drying devices may include concentrator nozzles for attaching to the end of a hair dryer to concentrate and direct airflow. However, such concentrator nozzles are incompatible with current devices that include drying and ironing features in one.

To this end, a need exists for a hair ironing apparatus that both dries and smooths freshly washed or wet hair that can style hair faster than conventional hair dryers and styling irons, and that can uniformly dry a greater amount of a section of hair and direct concentrated airflow to smooth hair, giving it a shiny and silky appearance. It is to such a hair iron that the inventive concepts disclosed herein are directed.

DETAILED DESCRIPTION OF EXEMPLARY EMBODIMENTS

Figure 1:
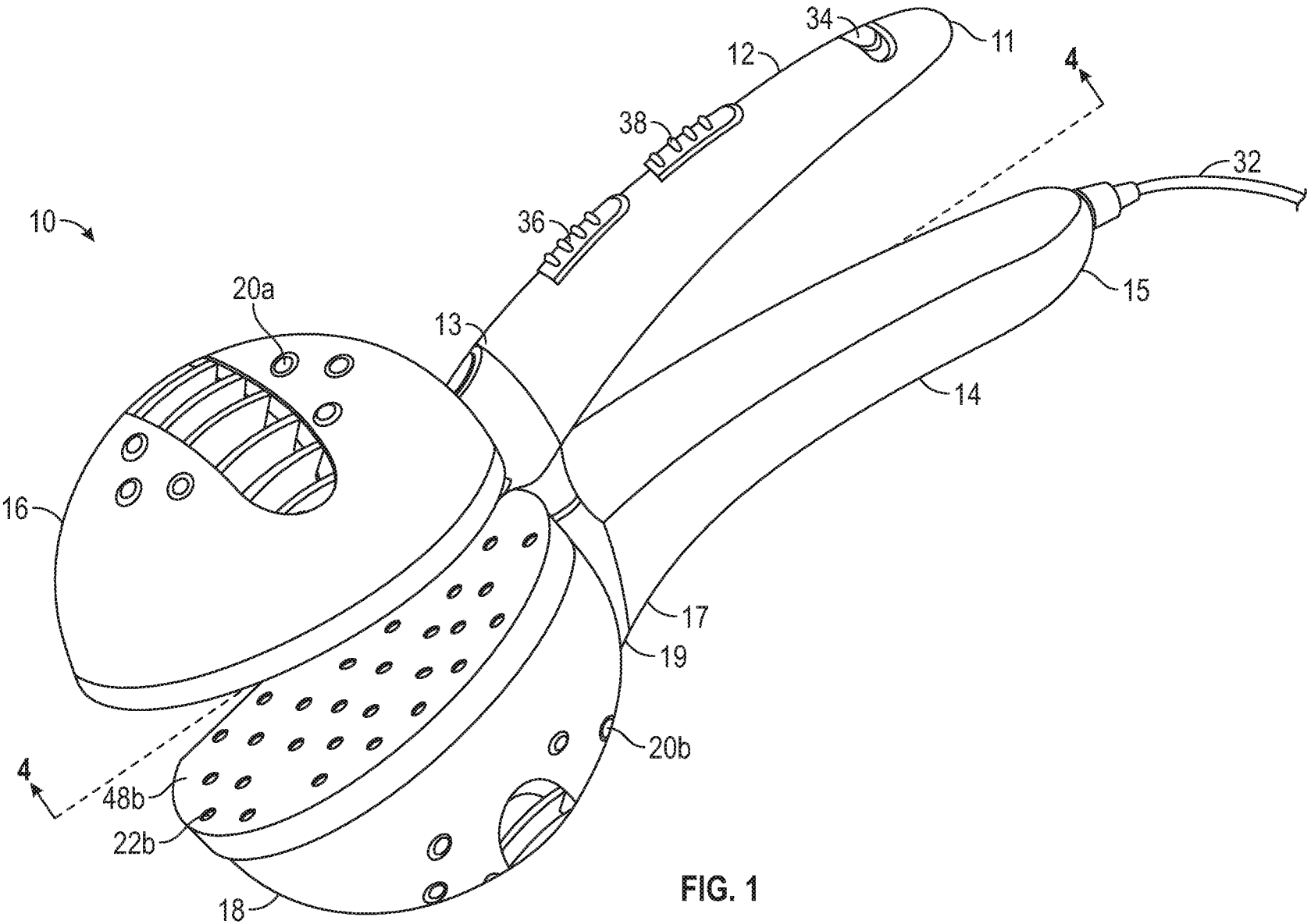
FIG. 1 is a perspective view of a hair iron constructed in accordance with the inventive concepts disclosed herein, shown in an open position.

In the following detailed description of embodiments of the inventive concepts, numerous specific details are set forth in order to provide a more thorough understanding of the inventive concepts. However, it will be apparent to one of ordinary skill in the art that the inventive concepts disclosed and claimed herein may be practiced without these specific details. In other instances, well-known features have not been described in detail to avoid unnecessarily complicating the instant disclosure.

As used herein, the terms "comprises," "comprising," "includes," "including," "has," "having" or any other variation thereof, are intended to cover a non-exclusive inclusion. For example, a process, method, article, or apparatus that comprises a list of elements or steps is not necessarily limited to only those elements or steps and may include other elements, steps, or features not expressly listed or inherently present therein.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B is true (or present).

In addition, use of the "a" or "an" are employed to describe elements and components of the embodiments herein. This is done merely for convenience and to give a general sense of the inventive concepts. This description should be read to include one or at least one and the singular also includes the plural unless it is obvious that it is meant otherwise.

Throughout this disclosure and the claims, the terms "about," "approximately," and "substantially" are intended to signify that the item being qualified is not limited to the exact value specified, but includes some slight variations or deviations therefrom, caused by measuring error, manufacturing tolerances, stress exerted on various parts, wear and tear, or combinations thereof, for example.

The use of the term "at least one" will be understood to include one as well as any quantity more than one, including but not limited to each of, 2, 3, 4, 5, 10, 15, 20, 30, 40, 50, 100, and all integers there between. The term "at least one" may extend up to 100 or 1000 or more, depending on the term to which it is attached; in addition, the quantities of 100/1000 are not to be considered limiting, as higher limits may also produce satisfactory results. Singular terms shall include pluralities and plural terms shall include the singular unless indicated otherwise.

The term "or combinations thereof" as used herein refers to all permutations and/or combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AAB, BBC, AAABCCCC, CBBAAA, CABABB, and so forth. The skilled artisan will understand that typically there is no limit on the number of items or terms in any combination, unless otherwise apparent from the context.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily referring to the same embodiment, although the inventive concepts disclosed herein are intended to encompass all combinations and permutations including one or more of the features of the embodiments described herein.

Figure 2:
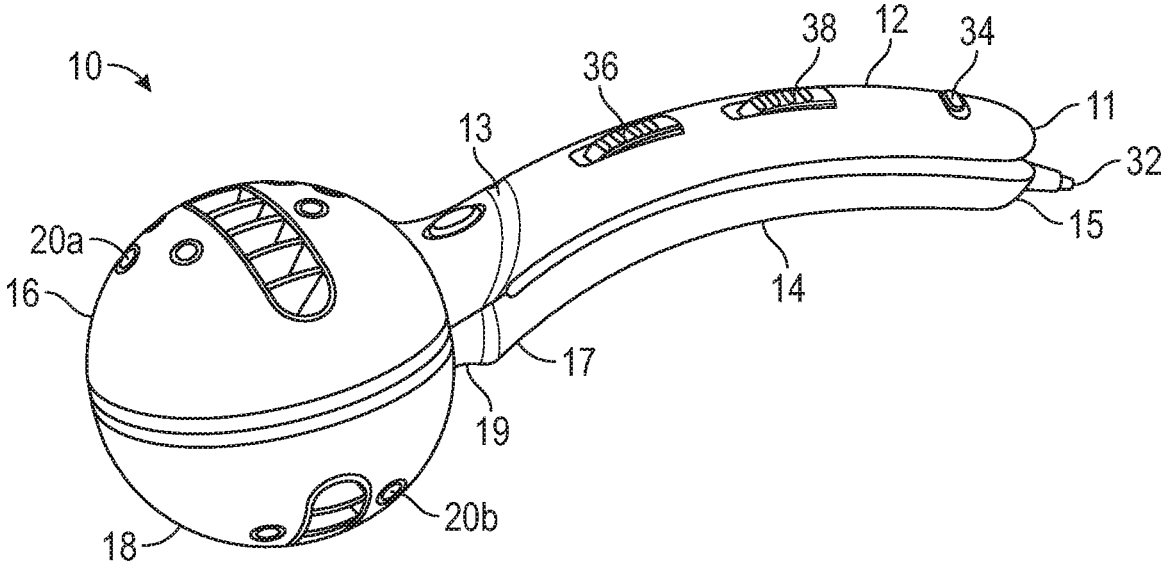
FIG. 2 is the hair iron of FIG. 1 shown in a closed position.

Referring now to the drawings, and more particularly to FIGS. 1-2, a hair iron 10 constructed in accordance with the inventive concepts disclosed herein is illustrated. The hair iron 10 includes a first handle member 12 having a first end 11 and a second end 13, a second handle member 14 having first end 15 and a second end 17, a first styling head 16 extending from the second end 13, and a second styling head 18 extending from the second end 17. The first handle member 12 and the second handle member 14 are pivotally connected to each other in a way that the styling heads 16 and 18 are movable between an open position, as shown in FIG. 1 (in which the styling heads 16 and 18 are spaced apart to receive a section of hair there between), and a closed position, as shown in FIG. 2 (in which the styling heads 16 and 18 are in face-to-face contact for styling a section of hair).

In one embodiment, the handle members 12 and 14 are pivotally connected at a medial portion 19 located in between the handle members 12/14 and the styling heads 16/18. It should be appreciated, however, that the handles 12 and 14 may be pivotally connected at, or at any point between, the first ends 11/15 and the second ends 13/17 of the handle members 12 and 14. By way of example only, the first ends 11 and 15 may include a spring-loaded hinge for pivotally connecting the handle members 12 and 14.

The handle members 12 and 14 and the styling heads 16 and 18 may be formed of any heat tolerant material that is safe for handing and positioning near a user's scalp when using the hair iron 10 to smooth a section of hair. Such materials may include, but are not limited to, polycarbonate. A power cord 32 may supply electricity to the hair iron 10, the receipt of which may be controlled by an on/off switch 34 located, for example, on one of the handle members 12 and 14. The handle members 12 and 14 may also include microcontrollers 36 and 38 for controlling air speed and temperature, for example, of motorized fans 24*a*/24*b* and heating elements 50*a*/50*b*, best shown in FIG. 4 and discussed in more detail below.

Figure 3:
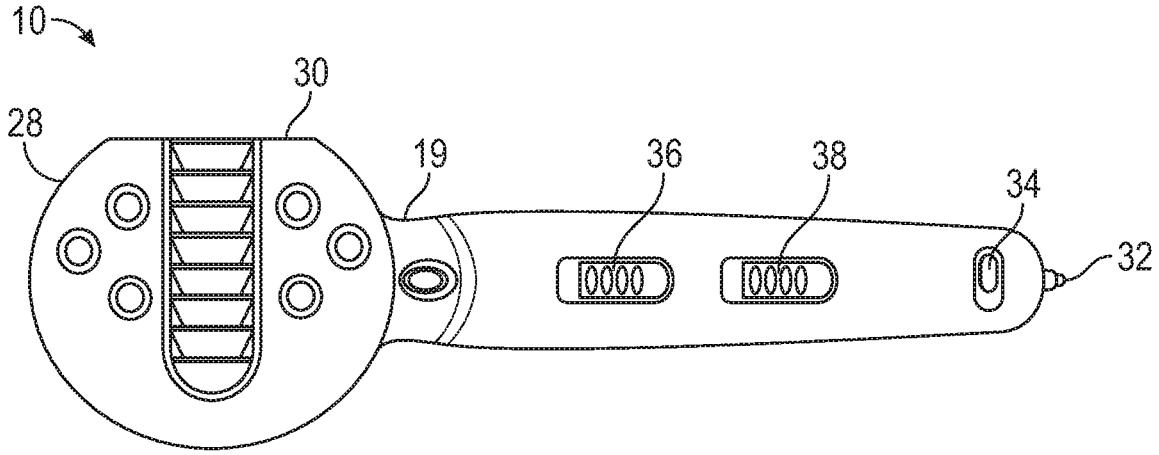
FIG. 3 is a top plan view of the hair iron of FIG. 2.
Figure 4:
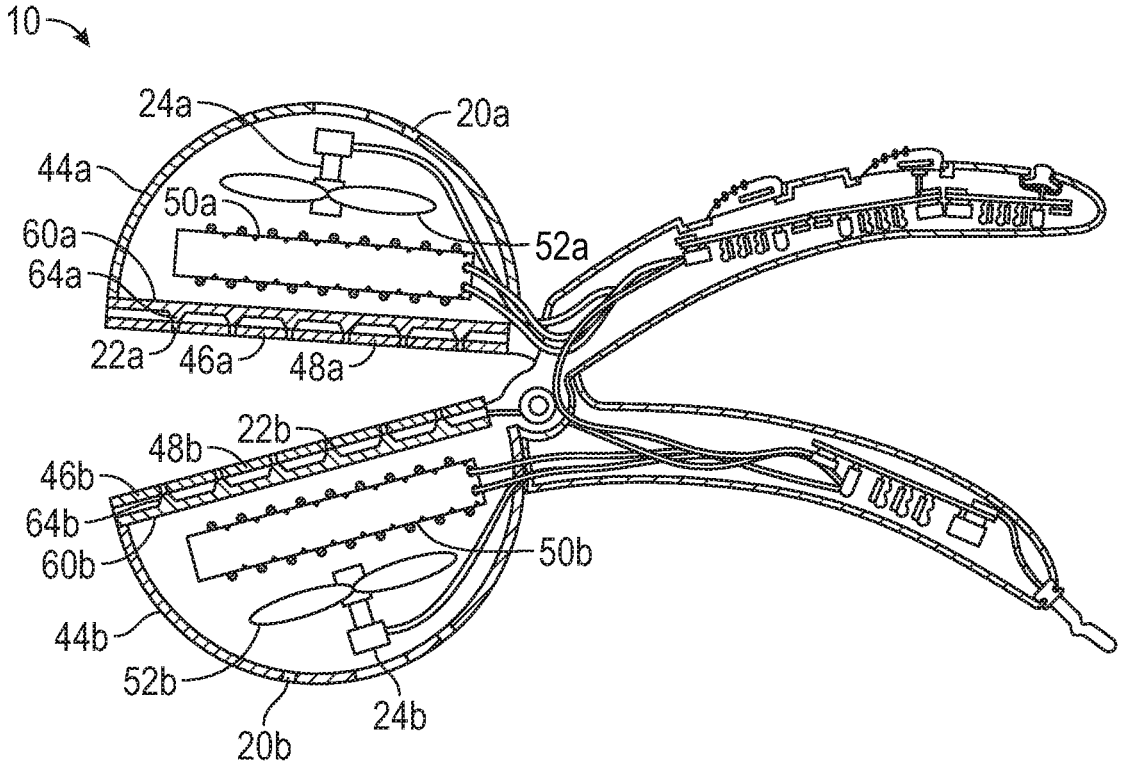
FIG. 4 is a cross-sectional view taken along line 4-4 of FIG. 1.
Figure 5:
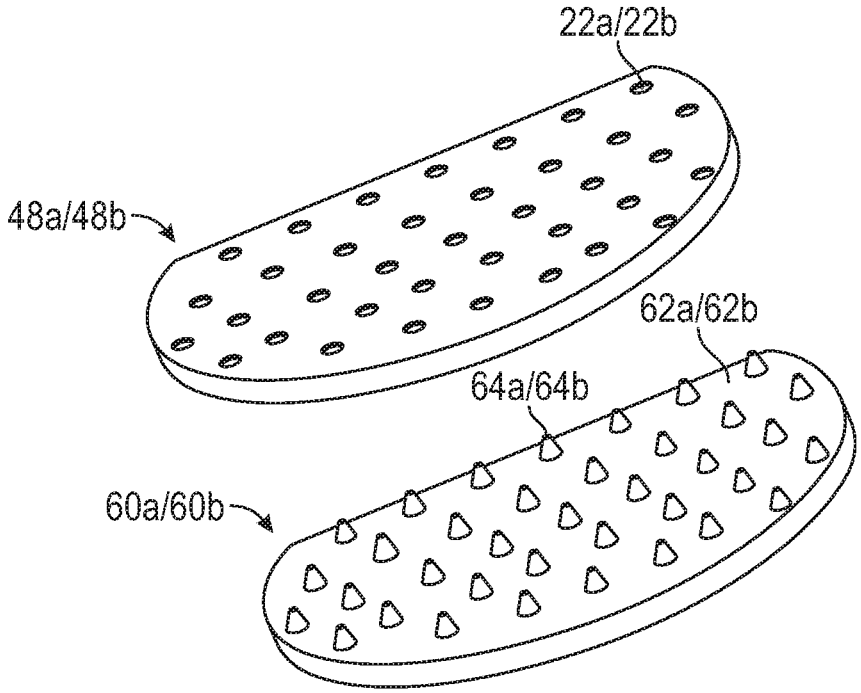
FIG. 5 is an exploded, perspective view of a styling element and a nozzle plate constructed in accordance with the inventive concepts disclosed herein.

Referring now to FIGS. 3-5, each of the first and second styling heads 16 and 18 includes a substantially hemispherical housing 44*a*/44*b* having an open equator 46*a*/46*b*, a styling element 48*a*/48*b* extending across the open equator 46*a*/46*b*, a heat element 50*a*/50*b* disposed in the housing 44*a*/44*b*, and a motorized fan 24*a*/24*b* disposed in the housing 44*a*/44*b*. Each of the housings 44*a*/44*b* includes a plurality of air inlets 20*a*/20*b* and each of the styling elements 48*a*/48*b* includes a plurality of air outlets 22*a*/22*b*. As shown in FIG. 4, the motorized fan 24*a*/24*b* is disposed between the air inlets 20*a*/20*b* and the heat element 50*a*/50*b* and includes a plurality of fan blades 52*a*/52*b* for pulling air through the air inlets 20*a*/20*b* and pushing air over the heat element 50*a*/50*b* and through the air outlets 22*a*/22*b*.

As shown in FIG. 3, each styling head 16 and 18 may also include an exterior surface 28 having a flat longitudinal surface 30 for positioning next to a user's scalp when the hair iron 10 is in use. The flat longitudinal surfaces 30 of each styling head are substantially perpendicular to the open equators 46*a*/46*b* and are in a co-planar relationship with one another.

The motorized fan 24*a*/24*b* may be any fan known by those having ordinary skill in the art to be suitable for use in a hair dryer. For example, the motorized fan 24*a*/24*b* may include, but is not limited to including, an axial fan, as shown in FIG. 4, or a cross-flow fan. Similarly, the heating element 50*a*/50*b* may be any heating element known by those having ordinary skill in the art to be suitable for use in combination with a motorized fan. For example, the heating element 50*a*/50*b* may include, but is not limited to including, a bare, coiled nichrome wire wrapped around insulating mica heating boards, or any known heating element that allows air flow to permeate through the same. The power cord 32 may be coupled to the motorized fan 24*a*/24*b* and the heating elements 50*a*/50*b*, respectively, to deliver electricity to the same. As alluded to above, control switches 36 and 38 may be provided on one or both of the handle members 12 and 14 for controlling the speed of the motorized fans 24*a*/24*b* and the heat of the heating elements 50*a*/50*b* to thereby control the speed and heat of the air flow discharged from the air outlets 22*a*/22*b* and onto a section of hair. It should be appreciated that the inner workings of the hair iron 10 including, but not limited to, the motorized fans 24*a*/24*b*, the heating elements 50*a*/50*b*, and the chords, such as chord chord 32, are not intended to be drawn to scale or electrical specificity, and one having ordinary skill in the art should appreciated that any known suitable electrical scheme may be used.

As shown in FIG. 5, the air outlets 22*a*/22*b* may be evenly distributed across the styling element 48*a*/48*b* to spread the heat and air more evenly onto a section of hair. The styling element 48*a*/48*b* may be formed of any heat tolerant material including, but not limited to, ceramic or titanium. For instance, a ceramic material may aid in evenly distributing heat across the styling element 48*a*/48*b*, while titanium material may cause the styling element 48*a*/48*b* to heat more quickly. The styling element 48*a*/48*b* may also be coated with a material including, but not limited to, tourmaline, to aid in further smoothing a section of hair when the styling elements 48*a*/48*b* are in face-to-face contact for styling a section of hair.

In one embodiment, each styling head 16 and 18 further includes a nozzle plate 60*a*/60*b* disposed in the housing 44*a*/44*b* between the heat element 50*a*/50*b* and the styling element 48*a*/48*b*. The nozzle plate 60*a*/60*b* includes a base 62*a*/62*b* and a plurality of nozzles 64*a*/64*b* extending from the base 62*a*/62*b* towards the styling element 48*a*/48*b*. Each nozzle 64*a*/64*b* is coaxially aligned with a corresponding air outlet 22*a*/22*b* of the styling element 48*a*/48*b* such that the motorized fan 24*a*/24*b* is capable of pulling air though the air inlets 20*a*/20*b* and pushing air over the heat element 50*a*/50*b* through the nozzles 64*a*/64*b* and through the air outlets 22*a*/22*b*. In this way, air being pulled by the motorized fan 24*a*/24*b* may exit the air outlets 22*a*/22*b* at a higher velocity, thereby delivering high-velocity and concentrated air flow to the surface of a section of hair. The nozzles 64*a*/64*b* further aid in directing heat down the hair shaft for a smoother and shinier appearance. The air inlets 20*a*/20*b* may be optionally include a screen or mesh across each air inlet to keep debris and hair out of the inlets.

In use, a user can style her hair by first grasping the handle members 12 and 14 and placing a section of hair in between the styling heads 16 and 18 in an open position, then moving the handle members 12 and 14 to a closed position with the flat longitudinal surface 30 facing the user's scalp, and then activating the motorized fan 24*a*/24*b* and heating elements 50*a*/50*b* to blow heated air through the air outlets 22*a*/22*b* while moving the handle members 12 and 14 through the hair. Preferably, a user moves the closed hair iron 10 away from the user's scalp along the length of a section of hair until reaching the end of the hair. When the user reaches the end of the hair, she may move the hair iron 10 into the open position and reposition the hair iron 10 towards the top of the scalp to dry and smooth a new section of wet hair.

When a section of wet hair is positioned between the two styling elements 48*a*/48*b*, it is sufficiently agitated by the motorized fans 24*a*/24*b* to dislodge wet hair strands from one another while still maintaining the section of hair between the styling elements 48*a*/48*b*. The styling elements 48*a*/48*b* do not become so hot as to scorch the wet drying hair, as would be the case with a conventional flat iron. Instead, the styling elements 48*a*/48*b* simultaneously dry and smooth out any frizz in the section of hair by maintaining the section of hair within a defined space. In one embodiment, each styling head 16 and 18 may optionally include a second heating element for heating the styling element 48/48*b*. In this way, a user can use the hair iron to smooth hair that is already dry.

Figure 6:
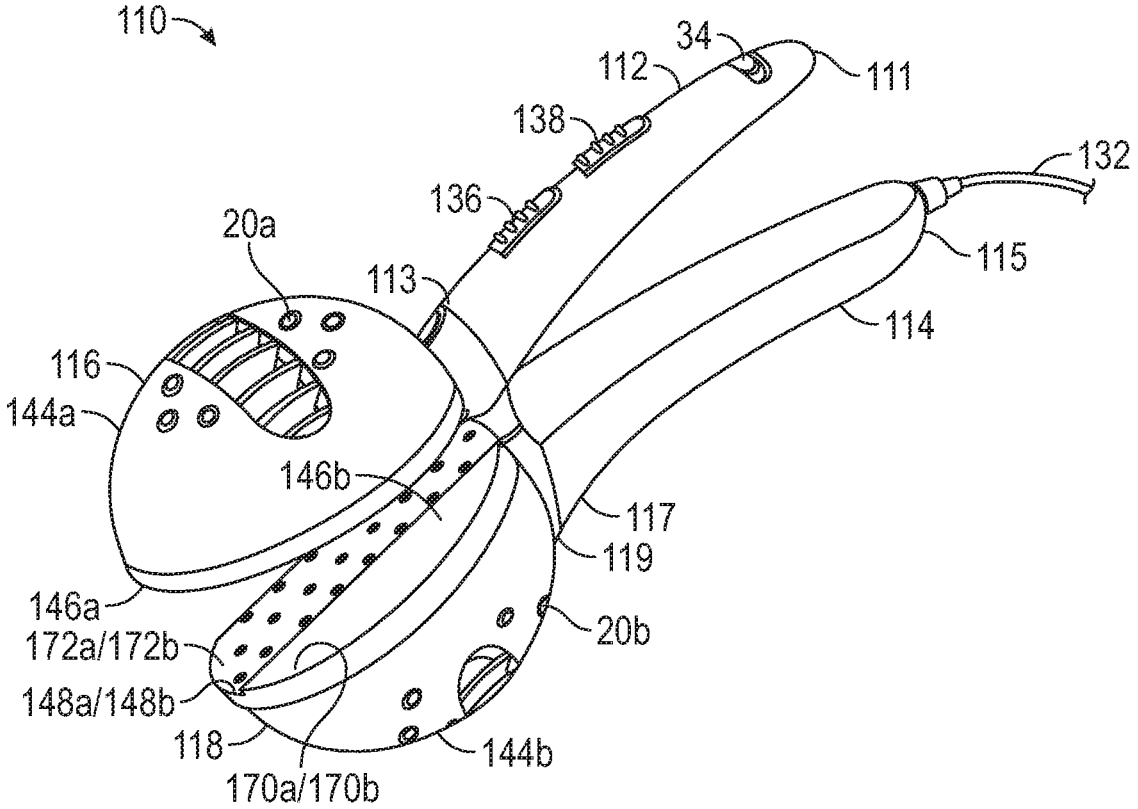
FIG. 6 is a perspective view of another embodiment of a hair iron.
Figure 7:
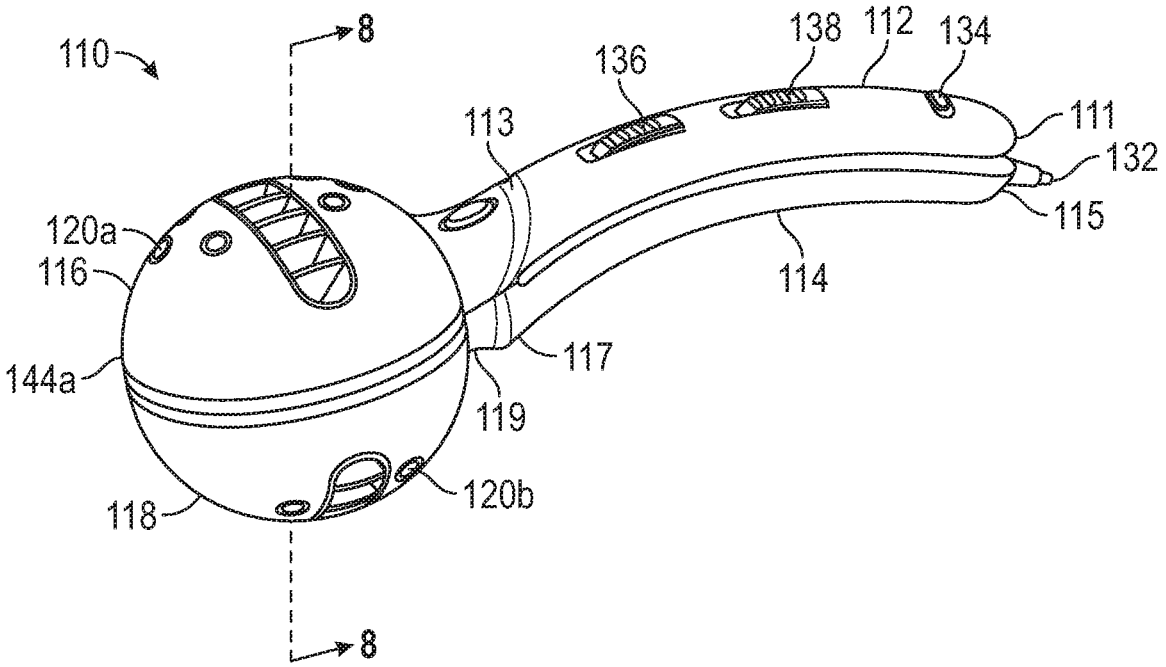
FIG. 7 is the hair iron of FIG. 6 shown in the closed position.
Figure 8:
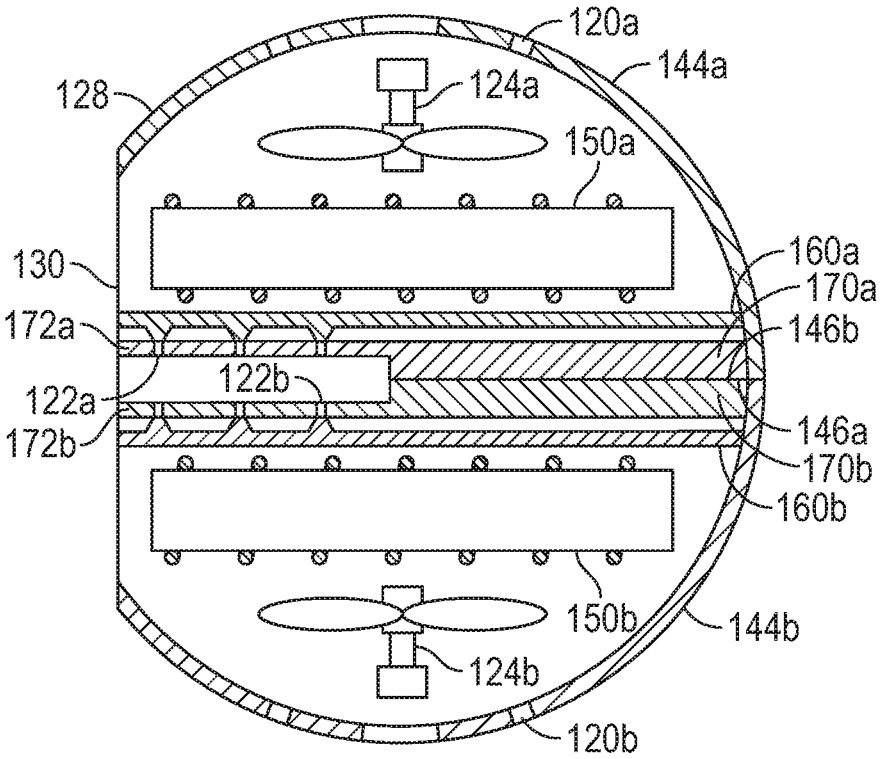
FIG. 8 is a cross-sectional view taken along line 8-8 of FIG. 7.

FIGS. 6-9 show another embodiment of a hair iron, such as hair iron 110. The hair iron 110 is constructed substantially similar to the hair iron 10 except that the hair iron 110 includes a pair of styling elements 148*a*/148*b* (best shown in FIG. 9), each having a first portion 170*a*/170*b*, and a second portion 172*a*/172*b*, wherein the first and second portions meet at an interface, the second portion 172*a*/172*b* having a plurality of air outlets 122*a*/122*b*. Similar to the hair iron 10, the hair iron 110 includes a first handle member 112 having a first end 111 and a second end 113, a second handle member 114 having first end 115 and a second end 117, a first styling head 116 extending from the second end 113, and a second styling head 118 extending from the second end 117. The first handle member 112 and the second handle member 114 are pivotally connected to each other in a way that the styling heads 116 and 118 are movable between an open position, as shown in FIG. 6 (in which the styling heads 116 and 118 are spaced apart to receive a section of hair there between), and a closed position, as shown in FIGS. 7 and 8 (in which the first portions 170*a*/170*b* of the styling elements 148*a*/148*b* are in face-to-face contact and the second portions 172*a*/172*b* are in a spaced apart relationship for styling a section of hair).

The handle members 112 and 114 may be pivotally connected at a medial portion 119 located in between the handle members 112/114 and the styling heads 116/118. It should be appreciated, however, that the handles 112 and 114 may be pivotally connected at, or at any point between, the first ends 111/115 and the second ends 113/117 of the handle members 112 and 114. By way of example only, the first ends 111 and 115 may include a spring-loaded hinge for pivotally connecting the handle members 112 and 114.

The handle members 112 and 114 and the styling heads 116 and 118 may be formed of any heat tolerant material that is safe for handing and positioning near a user's scalp when using the hair iron 110 to smooth a section of hair. Such materials may include, but are not limited to, polycarbonate. A power cord 132 may supply electricity to the hair iron 110, the receipt of which may be controlled by an on/off switch 134 located, for example, on one of the handle members 112 and 114. The handle members 112 and 114 may also include microcontrollers 136 and 138 for controlling air speed and temperature, for example, of motorized fans 124*a*/124*b* and heating elements 150*a*/150*b*, best shown in FIG. 8 and discussed in more detail below.

Each of the first and second styling heads 116 and 118 includes a housing 144*a*/144*b* having an open equator 146*a*/146*b*, the styling element 148*a*/148*b* extending across the open equator 146*a*/146*b*, the heat element 150*a*/150*b* disposed in the housing 144*a*/144*b*, and the motorized fan 124*a*/124*b* disposed in the housing 144*a*/144*b*. The housings 144*a*/144*b* may be substantially hemispherical. Each of the housings 144*a*/144*b* includes a plurality of air inlets 120*a*/120*b* and each of the styling elements 148*a*/148*b* includes a plurality of air outlets 122*a*/122*b*. As shown in FIG. 8, the motorized fan 124*a*/124*b* is disposed between the air inlets 120*a*/120*b* and the heat element 150*a*/150*b* and includes a plurality of fan blades 152*a*/152*b* for pulling air through the air inlets 120*a*/120*b* and pushing air over the heat element 150*a*/150*b* and through the air outlets 122*a*/122*b*.

As shown in FIG. 8, each styling head 116 and 118 may also include an exterior surface 128 having a flat longitudinal surface 130 for positioning next to a user's scalp when the hair iron 110 is in use. The flat longitudinal surfaces 130 of each styling head 116 and 118 are substantially perpendicular to the open equators 146*a*/146*b* and are in a coplanar relationship with one another.

The motorized fan 124*a*/124*b* may be any fan known by those having ordinary skill in the art to be suitable for use in a hair dryer. For example, the motorized fan 124*a*/124*b* may include, but is not limited to including, an axial fan, as shown in FIG. 8, or a cross-flow fan. Similarly, the heating element 150*a*/150*b* may be any heating element known by those having ordinary skill in the art to be suitable for use in combination with a motorized fan. For example, the heating element 50*a*/50*b* may include, but is not limited to including, a bare, coiled nichrome wire wrapped around insulating mica heating boards, or any known heating element that allows air flow to permeate through the same. The power cord 132 may be coupled to the motorized fan 24*a*/24*b* and the heating elements 150*a*/150*b*, respectively, to deliver electricity to the same. As alluded to above, control switches 136 and 138 may be provided on one or both of the handle members 112 and 114 for controlling the speed of the motorized fans 124*a*/124*b* and the heat of the heating elements 150*a*/150*b* to thereby control the speed and heat of the air flow discharged from the air outlets 122*a*/122*b* and onto a section of hair. It should be appreciated that the inner workings of the hair iron 10 including, but not limited to, the motorized fans 124*a*/124*b*, the heating elements 50*a*/50*b*, and the chords, such as chord 132, are not intended to be drawn to scale or electrical specificity, and one having ordinary skill in the art should appreciated that any known suitable electrical scheme may be used.

Figure 9:
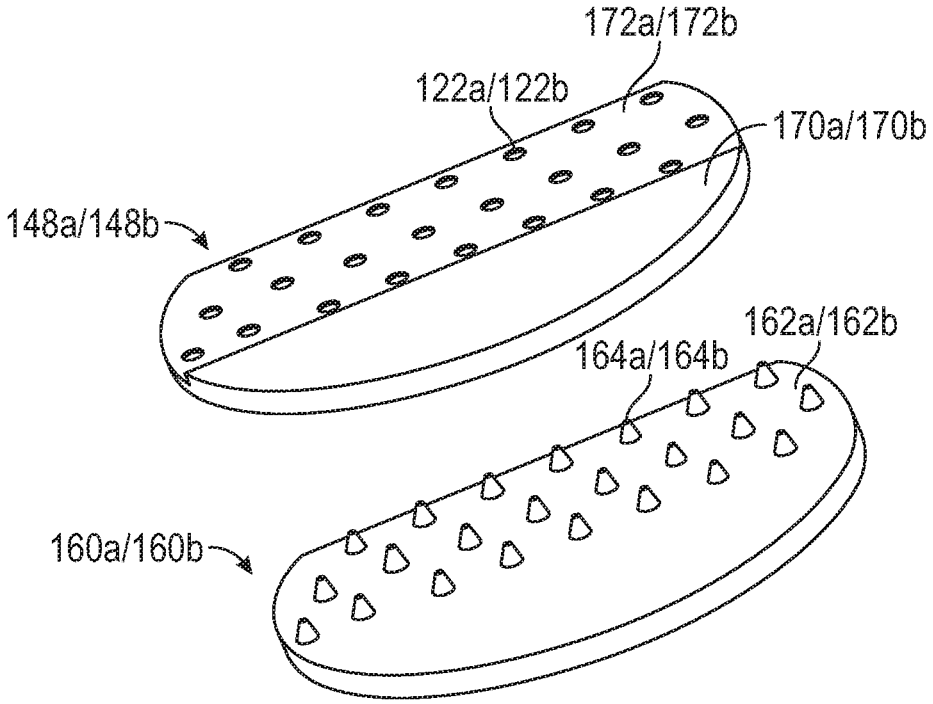
FIG. 9 is an exploded, perspective view of another embodiment of a styling element and a nozzle plate.

As shown in FIG. 9, the air outlets 122*a*/122*b* may be evenly distributed across the second portion 172*a*/172*b* of the styling element 148*a*/148*b* to spread the heat and air more evenly onto a section of hair. The styling element 148*a*/148*b* may be formed of any heat tolerant material including, but not limited to, ceramic or titanium. For instance, a ceramic material may aid in evenly distributing heat across the styling element 48*a*/48*b*, while titanium material may cause the styling element 48*a*/48*b* to heat more quickly. The styling element 148*a*/148*b* may also be coated with a material including, but not limited to, tourmaline, to aid in further smoothing a section of hair when the first portion 170*a*/170*b* of the styling elements 48*a*/48*b* are in face-to-face contact for styling a section of hair.

Each styling head 116 and 118 may further include a nozzle plate 160*a*/160*b* disposed in the housing 144*a*/144*b* between the heat element 150*a*/150*b* and the styling element 148*a*/148*b*. The nozzle plate 160*a*/160*b* includes a base 162*a*/162*b* and a plurality of nozzles 164*a*/164*b* extending from the base 162*a*/162*b* towards the styling element 148*a*/148*b*. Each nozzle 164*a*/164*b* is coaxially aligned with a corresponding air outlet 122*a*/122*b* of the styling element 148*a*/148*b* such that the motorized fan 124*a*/124*b* is capable of pulling air though the air inlets 120*a*/120*b* and pushing air over the heat element 150*a*/150*b* through the nozzles 164*a*/164*b* and through the air outlets 122*a*/122*b*. In this way, air being pulled by the motorized fan 124*a*/124*b* may exit the air outlets 122*a*/122*b* at a higher velocity, thereby delivering high-velocity and concentrated air flow to the surface of a section of hair. The nozzles 164*a*/164*b* further aid in directing heat down the hair shaft for a smoother and shinier appearance. The air inlets 120*a*/120*b* may be optionally include a screen or mesh across each air inlet to keep debris and hair out of the inlets.

In use, a user can style her hair by first grasping the handle members 112 and 114 and placing a section of hair in between the styling heads 116 and 118 in an open position, then moving the handle members 12 and 14 to a closed position with the flat longitudinal surface 130 facing the user's scalp, and then activating the motorized fan 124*a*/124*b* and heating elements 150*a*/150*b* to blow heated air through the air outlets 122*a*/122*b* while moving the handle members 112 and 114 through the hair. Preferably, a user moves the closed hair iron 110 away from the user's scalp along the length of a section of hair until reaching the end of the hair. In this way, the first portion 170*a*/170*b* of the styling elements 148*a*/148*b* leads the second portion 172*a*/172*b* as the styling heads 116 and 118 are moved away from the user's scalp along the length of the section of hair. The first portion 170*a*/170*b* of the styling elements 148*a*/148*b* are in face-to-face contact to help smooth the section of hair and the second portion 172*a*/172*b* of the styling elements 148*a*/148*b* are in a spaced apart relationship to help dry the hair. When the user reaches the end of the hair, she may move the hair iron 10 into the open position and reposition the hair iron 10 towards the top of the scalp to dry and smooth a new section of wet hair.

When a section of wet hair is positioned between the two styling elements 148*a*/148*b*, it is sufficiently agitated by the motorized fans 124*a*/124*b* to dislodge wet hair strands from one another while still maintaining the section of hair between the styling elements 148*a*/148*b*. The styling elements 148*a*/148*b* do not become so hot as to scorch the wet drying hair, as would be the case with a conventional flat iron. Instead, the styling elements 148*a*/148*b* simultaneously dry and smooth out any frizz in the section of hair by maintaining the section of hair within a defined space. In one embodiment, each styling head 116 and 118 may optionally include a second heating element for heating the first portion 170*a*/170*b* of the styling element 148/148*b*. In this way, a user can use the hair iron to smooth hair that is already dry. In other words, the first portion 170*a*/170*b* may be used as a conventional flat iron (without this use of the motorized fans 124*a*/124*b*) once the hair is dried.

From the above description, it is clear that the inventive concepts disclosed and claimed herein are well adapted to carry out the objects and to attain the advantages mentioned herein, as well as those inherent in the invention. While exemplary embodiments of the inventive concepts have been described for purposes of this disclosure, it will be understood that numerous changes may be made which will readily suggest themselves to those skilled in the art and which are accomplished within the spirit of the inventive concepts disclosed and claimed herein.

What is claimed is:

1. A hair iron, comprising:

a first handle member having a first end and a second end;

a first styling head having a first end extending from the second end of the first handle member and a second end opposite the first end;

a second handle member having a first end and a second end; and a second styling head having a first end extending from the second end of the second handle member and a second end opposite the first end, wherein each of the first styling head and the second styling head comprises:

a hollow housing having an open end and a plurality of air inlets extending therethrough;

a styling element having a plurality of air outlets disposed therethrough and extending across the open end and defining a flat hair contacting surface;

a heat element disposed within the housing;

a nozzle plate disposed within the housing between the heat element and the styling element, the plate including a base and a plurality of nozzles disposed on the base, each nozzle is coaxially aligned with a corresponding air outlet of the styling element, wherein each nozzle has a frustoconical shape protruding from the base and extending towards the styling element such that a tapered tip portion of each nozzle abuts an interior surface of the styling element; and a motorized fan disposed in the housing between the air inlets and the heat element for pulling air through the air inlets and pushing air over the heat element and through the nozzles and through the air outlets, wherein the styling heads are oriented so the styling elements are in a face-to-face relationship, and wherein the first handle member and the second handle member are pivotally connected to each other so the styling heads are movable between an open position in which the styling elements are spaced apart to receive hair there between and a closed position in which the styling elements are in contact.

2. The hair iron of claim 1, further including a medial portion between the handle members and the styling heads, wherein the first handle member and the second handle member are pivotally connected at the medial portion.

3. The hair iron of claim 1, wherein the first styling head further comprises a first flat longitudinal surface disposed between the first and second ends thereof, wherein the first flat longitudinal surface is substantially perpendicular to the styling element; and the second styling head further comprises a second flat longitudinal surface disposed between the first and second ends thereof, wherein the second flat longitudinal surface is substantially perpendicular to the styling element, wherein the first and second flat longitudinal surfaces are coplanar.

4. The hair iron of claim 1, wherein the plurality of air outlets are evenly distributed across each of the styling elements.

5. The hair iron of claim 1, wherein the hollow housing of the first styling head and the second styling head has a substantially hemispherical shape.

6. A hair iron, comprising:

a first handle member extending in a longitudinal direction and having a first end and a second end;

a first styling head having a first end extending from the second end of the first handle member and a second end opposite the first end;

a second handle member extending in the longitudinal direction and having a first end and a second end; and a second styling head having a first end extending from the second end of the second handle member and a second end opposite the first end, wherein each of the first styling head and the second styling head comprises:

a hollow housing having an open end and a plurality of air inlets extending therethrough;

a styling element extending across the open end and defining a hair contacting surface, the styling element having a first portion extending across the open end with a rigid planar face free of openings across an entirety of the rigid planar face and a second portion extending across the open end with a plurality of air outlets arranged in a plurality of longitudinal rows and extending through the second portion, the second portion being offset relative to the rigid planar face of the first portion, wherein no air outlets are positioned on the styling element between at least one peripheral edge of the hollow housing at the open end and an interface between the first and second portions, where the interface is spaced apart from the at least one peripheral edge in a direction transverse to the longitudinal direction, and wherein the first portion is positioned relative to the second portion such that the rigid planar face of the first portion leads the second portion when the styling heads are moved away from a user's scalp;

a heat element disposed within the housing; and a motorized fan disposed within the housing between the air inlets and the heat element for pulling air through the air inlets and pushing air over the heat element and through the air outlets, and wherein the first handle member and the second handle member are pivotally connected to each other so the styling heads are movable between an open position in which the styling elements are spaced apart to receive hair there between and a closed position in which the rigid planar faces of the first portions of the styling elements are in face-to-face contact and the second portions of the styling elements are in a face-to-face relationship with a gap therebetween.

7. The hair iron of claim 6, further including a medial portion between the handle members and the styling heads, wherein the first handle member and the second handle member are pivotally connected at the medial portion.

8. The hair iron of claim 6, wherein the first styling head further comprises a first flat longitudinal surface disposed between the first and second ends thereof, wherein the first flat longitudinal surface is substantially perpendicular to the styling element; and the second styling head further comprises a second flat longitudinal surface disposed between the first and second ends thereof, wherein the second flat longitudinal surface is substantially perpendicular to the styling element, wherein the first and second flat longitudinal surfaces are coplanar.

9. The hair iron of claim 6, wherein the plurality of air outlets are evenly distributed across the second portion of each of the styling elements.

10. The hair iron of claim 6, wherein the hollow housing of the first styling head and the second styling head has a substantially hemispherical shape.

11. The hair iron of claim 6, further comprising: a nozzle plate disposed within the hollow housing of each of the first and second styling heads, between the heat element and the styling element, the nozzle plate including a base and a plurality of nozzles disposed on the base, wherein each nozzle is coaxially aligned with a corresponding air outlet of the styling element.

12. The hair iron of claim 11, wherein each nozzle has a frustoconical shape protruding from the base and extending towards the styling element such that a tapered tip portion of each nozzle abuts an interior surface of the styling element.

* * * * *